US008561444B2

(12) United States Patent
Loreti

(10) Patent No.: US 8,561,444 B2
(45) Date of Patent: Oct. 22, 2013

(54) PROGRAMMABLE CYLINDER LOCK HAVING A HIGH NUMBER OF COMBINATIONS

(75) Inventor: Alberto Loreti, Antrodoco (IT)

(73) Assignee: Rielda Serrature s.r.l., Fiumicino (IT)

( * ) Notice: Subject to any disclaimer, the term of this patent is extended or adjusted under 35 U.S.C. 154(b) by 0 days.

(21) Appl. No.: 13/574,667

(22) PCT Filed: Nov. 15, 2010

(86) PCT No.: PCT/EP2010/006986

§ 371 (c)(1),
(2), (4) Date: Jul. 23, 2012

(87) PCT Pub. No.: WO2011/088861

PCT Pub. Date: Jul. 28, 2011

(65) Prior Publication Data

US 2012/0291505 A1 Nov. 22, 2012

(30) Foreign Application Priority Data

Jan. 25, 2010 (IT) ..... TO2010A0043

(51) Int. Cl.
*E05B 27/04* (2006.01)
*E05B 29/04* (2006.01)

(52) U.S. Cl.
USPC ..... 70/383; 70/340; 70/368; 70/384; 70/492; 70/493; 70/495

(58) Field of Classification Search
USPC ..... 70/377, 337–343, 382–385, 492–496, 70/421, 368, DIG. 22, DIG. 75
See application file for complete search history.

(56) References Cited

U.S. PATENT DOCUMENTS

| | | | | |
|---|---|---|---|---|
| 3,667,262 | A * | 6/1972 | Hill | 70/384 |
| 4,712,399 | A | 12/1987 | Mattossovich | |
| 6,119,495 | A * | 9/2000 | Loreti | 70/340 |
| 7,007,528 | B2 * | 3/2006 | Chong et al. | 70/492 |
| 7,526,935 | B2 * | 5/2009 | Huang et al. | 70/360 |
| 7,584,635 | B2 * | 9/2009 | Gan et al. | 70/338 |
| 7,712,344 | B2 * | 5/2010 | Shen | 70/495 |

(Continued)

FOREIGN PATENT DOCUMENTS

| | | |
|---|---|---|
| EP | 0 226 252 A2 | 6/1987 |
| EP | 0 900 310 B1 | 3/1999 |

OTHER PUBLICATIONS

International Search Report, dated Dec. 22, 2010, from corresponding PCT application.

*Primary Examiner* — Lloyd Gall
(74) *Attorney, Agent, or Firm* — Young & Thompson

(57) ABSTRACT

A programmable cylinder lock includes a stator and a cylindrical rotor, mounted therein for rotation around its own axis and having a keyhole, a number of key followers movable along their own longitudinal and transversal directions, intended to cooperate with a key inserted into the keyhole, a number of locking pins movable along their own longitudinal direction, the key followers and locking pins forming together a number of pairs and having toothings cooperating to define the lock codification, the rotor including a stop bar cooperating with a longitudinal groove of the stator and having projections cooperating with notches of the locking pins to immobilize them when the stop bar engages them, and a change bar slidingly coupled with the key followers to normally keep them engaged with the locking pins and to disengage them therefrom when the change bar provides a lock programming position.

7 Claims, 4 Drawing Sheets

(56) References Cited

U.S. PATENT DOCUMENTS

| | | | | |
|---|---|---|---|---|
| 7,836,739 | B2 * | 11/2010 | Huang et al. | 70/360 |
| 2003/0089149 | A1 * | 5/2003 | Suzuki et al. | 70/492 |
| 2004/0060331 | A1 | 4/2004 | Armstrong et al. | |
| 2004/0069030 | A1 * | 4/2004 | Takadama | 70/495 |
| 2005/0016234 | A1 * | 1/2005 | Strader et al. | 70/492 |
| 2006/0101880 | A1 * | 5/2006 | Ward-Dolkas et al. | 70/492 |
| 2008/0282755 | A1 * | 11/2008 | Grimmer et al. | 70/495 |
| 2009/0078012 | A1 | 3/2009 | Huang et al. | |
| 2009/0277239 | A1 * | 11/2009 | Mathachan | 70/383 |
| 2012/0304716 | A1 * | 12/2012 | Loreti | 70/492 |
| 2012/0304717 | A1 * | 12/2012 | Loreti | 70/493 |
| 2013/0036782 | A1 * | 2/2013 | Loreti | 70/493 |
| 2013/0047688 | A1 * | 2/2013 | Loreti | 70/493 |

* cited by examiner

PROGRAMMABLE CYLINDER LOCK HAVING A HIGH NUMBER OF COMBINATIONS

BACKGROUND OF THE INVENTION

The subject of this invention is a programmable cylinder lock, namely a lock comprising devices intended to allow providing the initial codification of the lock or, through a change operation, to modify the former lock codification in order to adjust the lock for being operated by a key different from the key to which the lock was formerly adapted.

More particularly, the invention concerns improvements in a kind of programmable cylinder lock which is known from the European Patents Nos. 0.226.252 and 0.900.310.

In a usual cylinder lock, which comprises a stator and a cylindrical rotor mounted inside the stator for rotation around its own axis and having a keyhole extending in the axis direction for the insertion of a key, a number of locking pins are mounted inside the rotor, movable perpendicularly to the axis on the extension of the keyhole plane, and each locking pin is intended to cooperate with a key segment whose codification is represented by the level of a tooth or recess of the key, situated within the considered segment. The fixed length of each locking pin is such that, when it cooperates with the corresponding segment of the correct key, the distal end of the locking pin corresponds to the cylindrical surface of the rotor and does not hinder its rotation, whereby, when all the locking pins are displaced in the respective correct positions by the correct key, the rotor can be rotated for operating the lock. When, on the contrary, one or more locking pins are situated in non correct positions, they (or the corresponding counter-pins which may be provided in the stator) extend through the cylindrical rotor surface and hinder its rotation and therefore the lock operation. Because the codification of the lock is represented by the fixed length of the locking pins, that is defined during the manufacture step, the lock can be operated only by a single correct key and cannot be otherwise programmed.

The programmable cylinder locks of the kind considered in this invention and described in the mentioned patents comprise, in the rotor which is rotatably mounted inside the stator, instead of locking pins of a preestablished length, a number of key followers movable along their own longitudinal and transversal directions, said key followers being intended to cooperate with the codification conformations of a key inserted into the rotor keyhole, and a corresponding number of locking pins movable along their own longitudinal direction, which form the blocking members of the lock. The key followers and the locking pins form together a number of pairs each including a key follower and a locking pin, and they are provided with toothings intended to mutually cooperate, in different relative positions, in order to define the lock codification. A transversally displaceable stop bar cooperating with a longitudinal groove of the stator and having projections susceptible of cooperating with notches of the locking pins has the purpose of immobilizing the locking pins when the rotor is made to rotate within the stator and, as a consequence, the stop bar comes out of said groove and engages the locking pins. A change bar, which is transversally displaceable and is slidingly coupled with the key followers, normally keeps the key followers engaged with the locking pins but, when said change bar comes into said groove of the stator, it transversally displaces the key followers and disengages the same from the locking pins, thus allowing to modify the lock codification by means of the replacement of the former key by a different key.

In a lock of this kind it is required that the number of possible codification combinations, namely the number of different keys foreseen for the different locks of the same kind, be the higher possible. One of the parameters which determine the number of possible combinations is the number of codification levels that may be foreseen for the key segments, and this number depends on the pitch of the cooperating toothings of each pair of key followers and locking pins. The more small is this pitch, the more high is the number of possible codifications. However, the pitch of these toothings cannot be reduced below certain limits, on one hand because this would involve greater manufacture difficulties, and on the other hand because the engagement between the pairs of key followers and locking pins would no more have a sufficient mechanical strength.

SUMMARY OF THE INVENTION

The main object of this invention is to improve a lock of the considered kind in order to make up for the stated drawback, by allowing to increase the number of possible codifications levels without having recourse to a reduction of the pitch of the cooperating toothings of the key followers and the locking pins.

This object is attained according to the invention, in a lock of the considered kind, in that one of the two members, which compose at least some of the pairs each including a locking pin and a key follower, is provided with two parallel and adjacent toothings, each toothing having its pitch phase displaced with respect to the pitch phase of the other toothing, and in that at least one of said members which compose the pair including a locking pin and a key follower also has a limited mobility along the direction of the rotor axis, whereby said member is allowed to displace in such a way that the mutual engagement between both members may take place into the one or the other of said two toothings of one of the members forming the pair.

Thanks to this arrangement, the number of relative positions in which may be coupled the locking pins and the key followers forming the pairs is doubled, because in each case use can be made of the one or the other toothing, whose pitch are out of phase. In this manner, without reducing the toothing pitch, a number of codification combinations is obtained which corresponds to the number of codification combinations which could be obtained by halving the toothing pitch. It follows that the number of different keys which can be provided is increased without reducing either the manufacture ease or the mechanical strength of the lock.

Preferably, said two toothings, of the locking pin or of the key follower which together form a pair, are mutually phase displaced of a half of a pitch. In this manner there is obtained a uniform difference among the levels that may be provided by the alternate use of the two toothings.

Preferably, the member of each pair including a locking pin and a key follower, which has two toothings, is the locking pin, whereas the corresponding key follower has a single toothing.

Preferably, both members of each pair including a locking pin and a key follower have a limited mobility along the direction of the rotor axis.

It is of advantage that the teeth of the toothing of one of the members forming each pair including a locking pin and a key follower are provided with a bevel intended to render more easy the relative displacement of the members for mutually engaging the respective toothings.

In case, said teeth bevel can be foreseen for both the toothings of the key followers and of the locking pins.

The different features stated aim to obtain the maximum easy of engagement between the toothings of the pairs of locking pins and key followers.

It is of advantage that the key followers are provided, in the region in which they are slidingly coupled with the change bar, with an extension by means of which they are positively hooked to the change bar. In this way is prevented the possibility that the key followers take by chance any abnormal position capable of compromising a good lock operation.

BRIEF DESCRIPTION OF THE DRAWINGS

These and other features, objects and advantages of the subject of the present invention will more clearly appear from the following description of an embodiment, being a not limiting example, with reference to the accompanying drawings, wherein.

DETAILED DESCRIPTION OF THE PREFERRED EMBODIMENT

Figure 2:
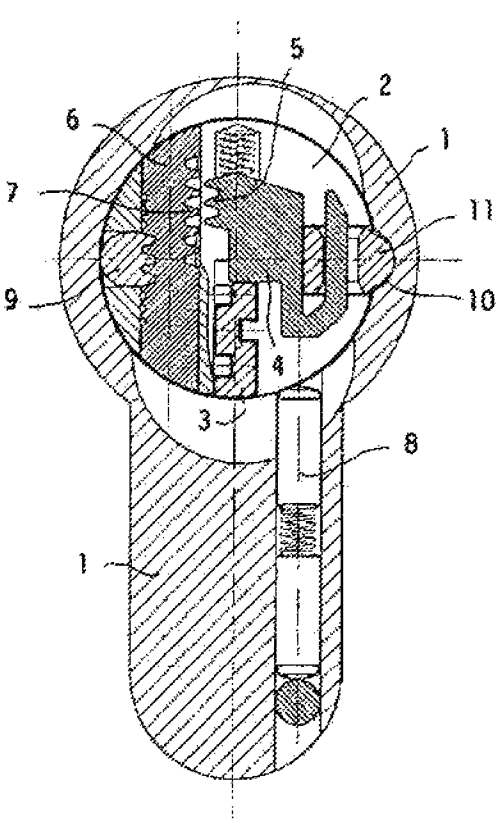
FIG. 2 Prior Art
FIG. 2 shows a cross section corresponding to that of FIG. 1, but in a condition of change.
Figure 1:
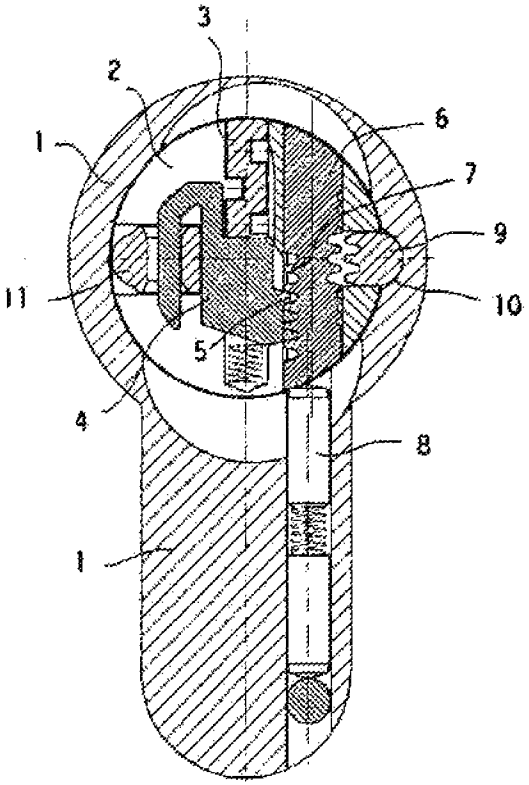
FIG. 1 Prior Art
FIG. 1 represents, for the purpose of reference, a cross section of a programmable cylinder lock known from the European Patent No. 0.900.310, in a condition of normal operation.

At first, reference to FIGS. 1 and 2 will be made in order to recall the general structure and the operation of a lock of the considered kind, for whose particulars reference is made to the cited documents. Number 1 designates a stator inside which there is rotatably mounted a rotor 2 susceptible of receiving in its keyhole a key 3. Inside rotor 2 are mounted a number of key followers 4 lying in a plane perpendicular to the axis of rotor 2 and having mobility along their own longitudinal and transversal directions. The key followers 4 are intended to cooperate with the codification conformations of key 3. In addition, inside rotor 2 are mounted a corresponding number of locking pins 6, each locking pin being coplanar with one of the key followers 4 and having mobility along its own longitudinal direction. In the shown case, the locking pins 6 cooperate with counterpins 8 and, together with them, form the blocking members of the lock. The key followers 4 have a toothing 5, the locking pins have a toothing 7, and these toothings are intended to mutually cooperate. This cooperation may take place in different relative positions, in order to determine the lock codification. A stop bar 9 is displaceable in a transverse direction within rotor 2 is susceptible to cooperate with a longitudinal groove 10 of stator 1, has protrusions intended for cooperating with recesses of the locking pins 6, and serves for immobilizing the locking pins 6 when rotor 2 is made to rotate within stator 1 and, as a consequence, the stop bar 9 comes out of said groove 10 and engages the locking pins 6. A change bar 11 which is transversally displaceable in rotor 2 is slidingly coupled with the key followers 4, and normally the change bar 11 keeps the key followers 4 engaged with the locking pins 6 as shown by FIG. 1 but, when said change bar 11, due to a rotation of rotor 2, comes to correspond to said groove 10 of stator 1 and penetrates therein, it transversally displaces the key followers 4 and disengages the same from the locking pins 6, as shown by FIG. 2. Then, by means of the replacement of the former key 3 by a different key, it is possible to modify the lock codification.

As it may be remarked, the pitch of toothings 5 and 7, which determines the possible positions for the lock codification, is not very small, and it cannot be reduced at will because this reduction would involve some manufacture difficulties and a weakening of the engagement between key followers and locking pins. This fact limits the possibility of increasing the number of possible codification positions and, therefore, the number of different keys which can be provided for a lock of this kind.

Figure 3:
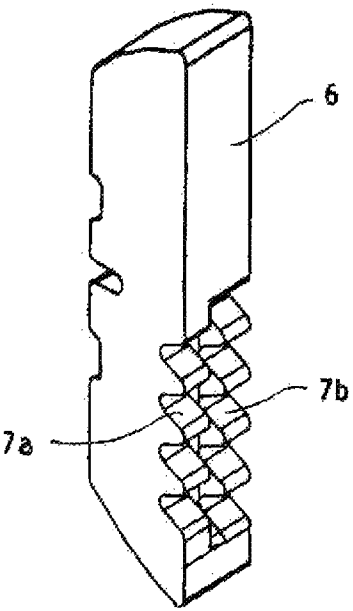
FIG. 3 shows in perspective a locking pin of the lock according to the invention, which is provided with two toothings relatively out of phase.

As already stated, according to the invention one of the two component parts of at least some of the pairs comprising a locking pin and a key follower, preferably the locking pin, is provided with two parallel adjacent toothings, each of these toothings having its pitch phase displaced with respect to the pitch phase of the other toothing. This feature appears in particular from FIG. 3. As it may be observed, the locking pin 6, for the remaining substantially conforming the known shapes, instead of having a single toothing 7, has two parallel adjacent toothings 7*a* and 7*b*, and the pitches of these two toothings are mutually phase displaced. In the shown example, the phase displacement amounts to a half of a pitch, and this is the preferred condition.

Figure 4:
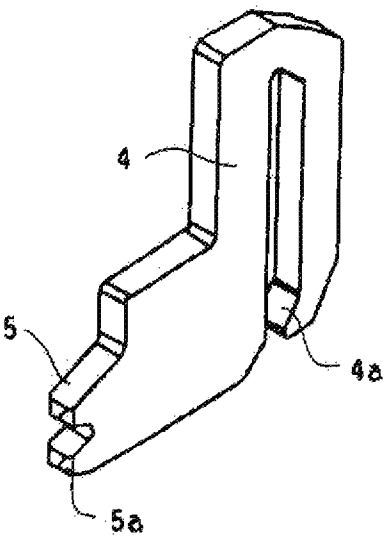
FIG. 4 shows in perspective a key follower of the lock according to the invention.

The key follower 4 represented in FIG. 4 has as customary a single toothing 5. According to the position of the key follower 4 with respect to the locking pin 6, this toothing 5 is susceptible of engaging the toothing 7*a* or the toothing 7*b* of the locking pin. For example, according to FIG. 5, the toothing 5 of the key follower 4 engages the toothing 7*b* of the locking pin 6. Because the two toothings 7*a* and 7*b* are mutually displaced by a half of a pitch, it ensues that the possible relative positions of the key follower 4 and the locking pin 6 do not differ, as usually, by a toothing pitch, but only by a half of a pitch. Therefore, being equal all other conditions and without any reduction of the toothing pitch, the number of possible relative positions of each key follower with respect to the corresponding locking pin is doubled. Therefrom ensues a very great increase of the number of possible codification combinations of the lock and of the corresponding key.

In order that the key followers 4, when they are approached to the corresponding locking pins 6 when programming the lock, can engage as needed the one or the other of the toothings 7*a* and 7*b*, a relative displacement should be allowed between the key followers 4 and the locking pins 6 in the direction of the axis of rotor 2. For this reason, according to the invention, it is needed that at least one of said two members, the key follower 4 and the locking pin 6, which compose each pair, has a limited mobility along the direction of the rotor axis, whereby it can displace in such a way that the mutual engagement of the two members takes place as needed in the one or the other of said two toothings of one of the involved component parts. This mobility can be assigned indifferently to the key followers 4 or to the locking pins 6, but it is preferable that this mobility is assigned to both said component parts, whereby its extension can be reduced in a corresponding way.

If this is considered suitable, said displacement (which however aims spontaneously taking place) may be favored by a light bevel of the teeth of some toothings of the one or the other or both the component parts. This bevel is represented in 5*a* in FIG. 4 for the teeth of the key follower 4.

In the example shown and described, the double toothing 7*a*, 7*b* has been assigned to the locking pins 6, whereas the key followers 4 have a single toothing 5. However it is to be remarked that the same behavior can be obtained by providing a double toothing on the key followers and a single toothing on the locking pins. The selection between these two possibilities can be imposed by a preference of the designer or by a manufacture advisability.

Figure 6:
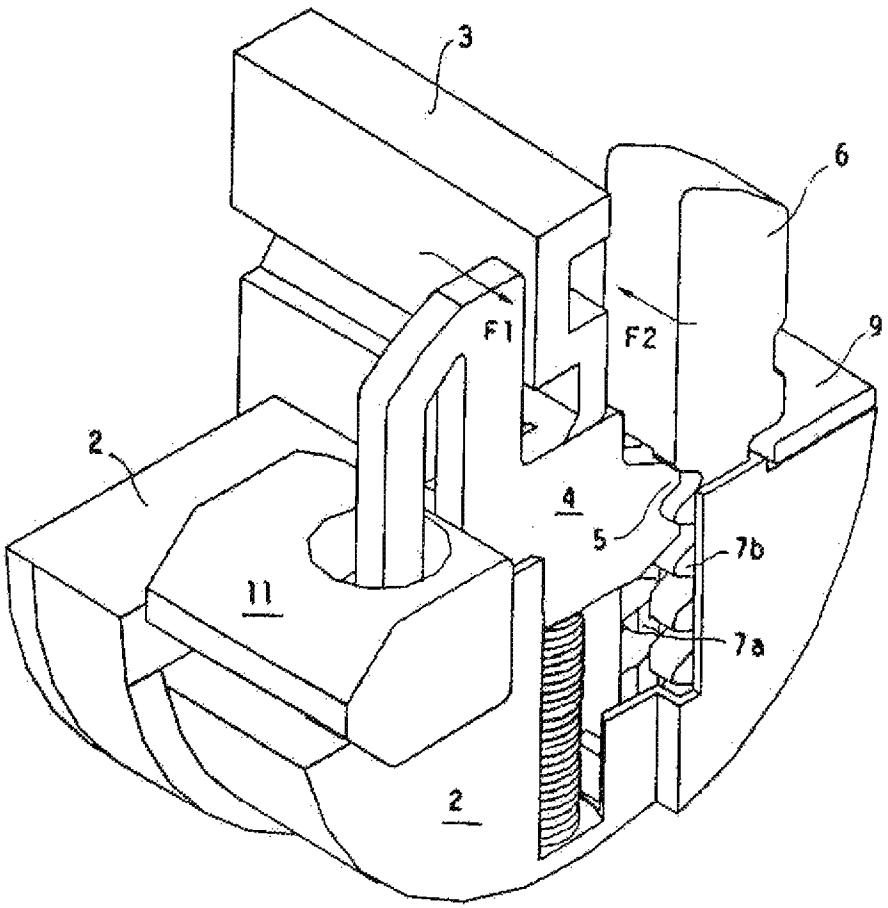
FIG. 6 shows in perspective a portion of a rotor segment and of the key, with a pair comprising a locking pin and a key follower relatively engaged, in a first condition.
Figure 7:
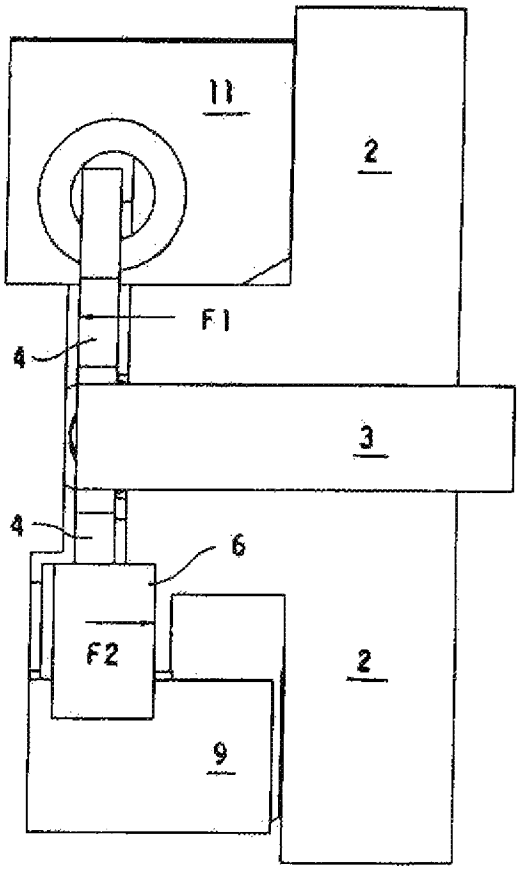
FIG. 7 is a plan view of the component parts represented in FIG. 6.

A further clarification of the behavior of the distinctive component parts of the invention is given by FIGS. 6 to 9, wherein it is supposed that the limited displacement along the direction of the axis of rotor 2 is allowed both to the key followers 4 and to the locking pins 6. FIGS. 6 and 7 refer to the case in which a key follower 4 is engaging the toothing 7*b* of a locking pin 6, whereas FIGS. 8 and 9 refer to the case in which a key follower 4 is engaging the toothing 7*a* of a locking pin 6. Of course, the one or the other of these cases takes place according to the fact that, in the position in which the key 3 has brought the key follower 4, the pitch of toothing 5 of the key follower 4 corresponds to the pitch of either one or the other of the toothings 7*a* and 7*b* of the locking pin 6.

In the case of FIGS. 6 and 7, the key follower 4 displaces along the direction of the axis of rotor 2 in the sense of arrow F1, whereas at the same time the locking pin 6 displaces in the direction of the axis of rotor 2 in the opposite sense, according to arrow F2, whereby the toothing 5 of the key follower 4 aligns with the toothing 7*b* of the locking pin 6 and can engage the same.

Figure 8:
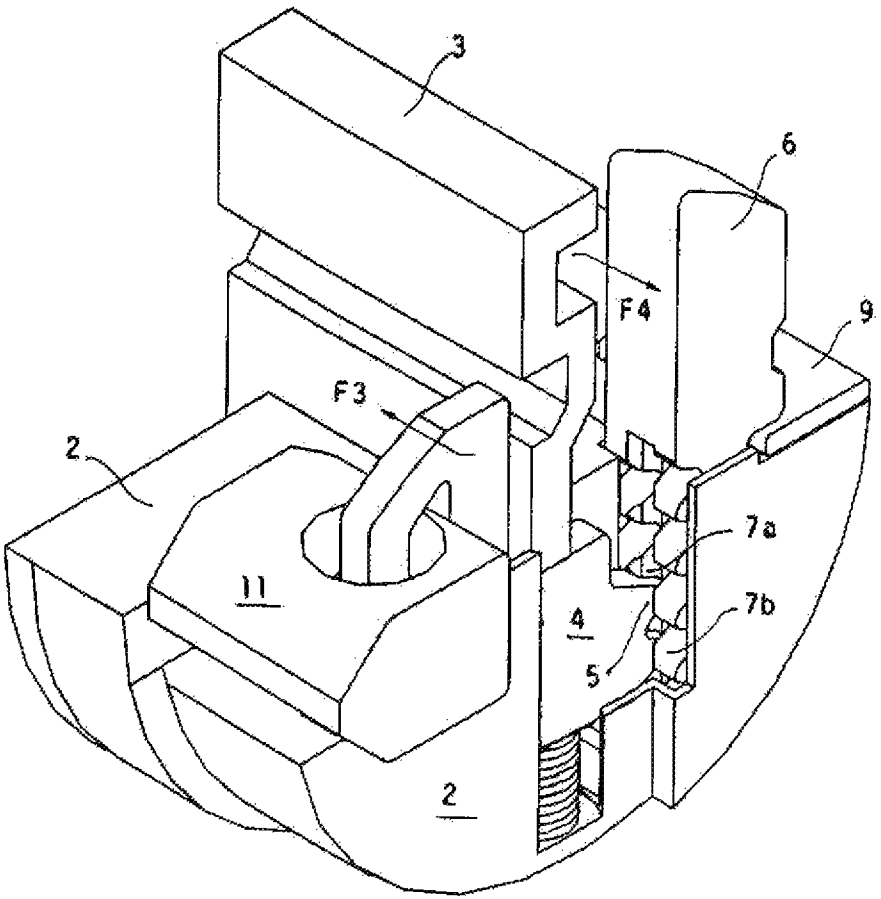
FIG. 8 shows in perspective a portion of a rotor segment and of the key, with a pair comprising a locking pin and a key follower relatively engaged, in a second condition.
Figure 9:
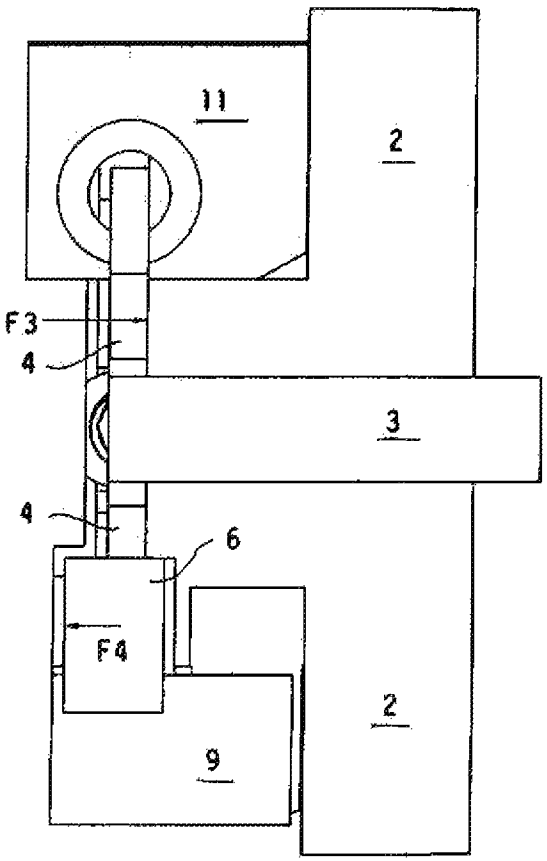
FIG. 9 is a plan view of the component parts represented in FIG. 8.

On the contrary, in the case of FIGS. 8 and 9, the key follower 4 displaces along the direction of the axis of rotor 2 in the sense of arrow F3, whereas at the same time the locking pin 6 displaces in the direction of the axis of rotor 2 in the opposite sense, according to arrow F4, whereby the toothing 5 of the key follower 4 aligns with the toothing 7*a* of the locking pin 6 and can engage the same.

It is to be remarked that the senses of the two arrows F1 and F3 according to which displaces the key follower 4 are opposite in the two cases shown, and like this are opposite in the two cases the senses of the two arrows F2 and F4 according to which displaces the locking pin 6.

Figure 5:
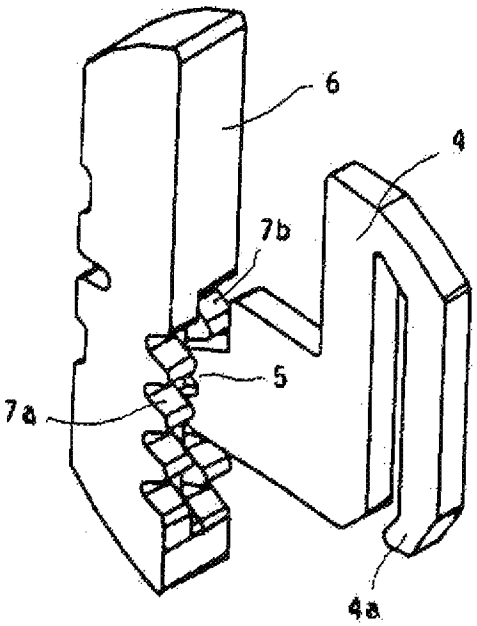
FIG. 5 shows in perspective the locking pin according to FIG. 3 and the key follower according to FIG. 4, relatively engaged.

It is of advantage that the key followers 4, as it may be observed in FIGS. 4 and 5, have an extension 4*a* in the region in which they are slidingly coupled with the change bar 11. By means of the extension 4*a* the key followers 4 are positively hooked to the change bar 11. In this way is prevented the possibility that the key followers, due to their mobility, may take by chance some abnormal position capable of compromising a good lock operation.

Thanks to the application of the invention becomes possible a great increase of the number of possible codification combinations of the lock, and therefore of the possible number of different keys, without resorting to a reduction of the toothing pitch of the component parts, and therefore without causing particular manufacture difficulties or any weakening of the component parts.

All the described features may be applied to all the pairs comprising a key follower and a locking pin of the lock or even, for the reason of simplification, only to some pairs, by accepting in this case a reduction of the extent of advantages offered by the invention.

The characteristics of the invention may be applied to the stated kind of locks, irrespective of they being provided with master keys or not.

It should be understood that this invention is not limited to the embodiment described and shown as an example. Several possible modifications have been pointed out in the course of the description, and others are within the ability of those skilled in the art. These modification and others, and any replacement by technically equivalent means, can be made to what has been described and shown, without departing from the spirit of the invention and the scope of this Patent as defined by the appended Claims.

The invention claimed is:

1. A programmable cylinder lock of the type comprising a stator (1) and a cylindrical rotor (2), mounted inside the stator (1) for rotation around its own axis and having a keyhole extending in a direction of the axis for insertion of a key (3), and comprising inside rotor (1) a number of key followers (4) movable along their own longitudinal and transversal directions, intended to cooperate with codification conformations of a key (3) inserted into the keyhole of the cylindrical rotor (2), and a number of locking pins (6) movable along their own longitudinal direction, which form lock blocking members, said key followers (4) and locking pins (6) forming together a number of pairs each including a locking pin (6) and a key follower (4) and having toothings (7,5) intended to mutually cooperate, in different relative positions, in order to define a lock codification, the cylindrical rotor (2) including a transversally displaceable stop bar (9) cooperating with a longitudinal groove (10) of the stator (1) and having projections susceptible of cooperating with notches of the locking pins (6) in order to immobilize the locking pins (6) when the cylindrical rotor (2) is made to rotate within the stator (1) and the stop bar (9) comes out of said groove (10) and engages the locking pins (6), and comprising a change bar (11) which is transversally displaceable and is slidingly coupled with the key followers (4) in order to normally keep the key followers (4) engaged with the locking pins (6) and to disengage the key followers (4) from the locking pins (6) when said change bar (11) comes into said groove (10) of the stator (1) and provides a lock programming position, characterized in that one of the lock blocking members (4,6), which compose at least some of the pairs each including a locking pin (6) and a key follower (4), are provided with two parallel and adjacent toothings (7*a*, 7*b*), each toothing (7*a*,7*b*) having its pitch phase displaced with respect to the pitch phase of the other toothing (7*b*,7*a*), and in that at least one of said lock blocking members (4,6), which compose a pair including a locking pin (6) and a key follower (4), has a limited mobility along the direction of the axis of cylindrical rotor (2), whereby a lock blocking member (4 or 6) is allowed to displace in such a way that a mutual engagement between the lock blocking members (4,6) may take place into one or the other of said two toothings (7*a*,7*b*) of one of the lock blocking members (4,6) forming the pair.

2. The programmable cylinder lock as set forth in claim 1, characterized in that said two toothings (7*a*,7*b*) of the locking pin (6) or of the key follower (4) which together form the pair are mutually phase displaced of a half of a pitch.

3. The programmable cylinder lock as set forth in claim 1, characterized in that the lock blocking member of each pair including a locking pin (6) and a key follower (4), which has two toothings (7*a*,7*b*), is the locking pin (6), whereas the corresponding key follower (4) has a single toothing (5).

4. The programmable cylinder lock as set forth in claim 1, characterized in that both lock blocking members (4,6) of each pair including a locking pin (6) and a key follower (4) have a limited mobility along the direction of the axis of the cylindrical rotor (2).

5. The programmable cylinder lock as set forth in claim 1, characterized in that teeth of the toothing of one of the lock blocking members (4,6) forming each pair including a locking pin (6) and a key follower (4) are provided with a bevel (5*a*) intended to render more easy a relative displacement of the lock blocking members (4,6) for mutually engaging the respective toothings.

6. The programmable cylinder lock as set forth in claim 5, characterized in that both the toothings of the key followers (4) and of the locking pins (6) are provided with said bevel (5*a*).

7. The programmable cylinder lock as set forth in claim 1, characterized in that said key followers (4) are provided, in a region in which they are slidingly coupled with the change bar (11), with an extension (4*a*) by means of which they are positively hooked to the change bar (11).

* * * * *